United States Patent [19]

Stark et al.

[11] 4,362,111

[45] Dec. 7, 1982

[54] COVERED HOPPER CAR

[76] Inventors: Marvin Stark, 727 Wax Myrtle, Houston, Tex. 77079; Franklin P. Adler, 105 Boyd Cir., Michigan City, Ind. 46360

[21] Appl. No.: 203,242

[22] Filed: Nov. 3, 1980

[51] Int. Cl.[3] ..... B61D 7/02; B61D 17/08

[52] U.S. Cl. ..... 105/247; 105/407; 105/409

[58] Field of Search ..... 105/247, 248, 358, 360, 105/409, 396, 404, 407; 296/181

[56] References Cited

U.S. PATENT DOCUMENTS

| | | | |
|---|---|---|---|
| 2,953,996 | 9/1960 | Allen | 105/406 R |
| 3,240,168 | 3/1966 | Charles et al. | 105/406 R |
| 3,509,827 | 5/1970 | Sutter | 105/248 |
| 3,583,331 | 6/1971 | Mowatt-Larssen | 105/248 X |
| 4,003,319 | 1/1977 | Campbell et al. | 105/248 |

*Primary Examiner*—Randolph Reese

*Attorney, Agent, or Firm*—James J. Conlon

[57] ABSTRACT

A covered hopper car having curved side wall units joined to a curved roof structure with a hollow beam side plate and having a reinforcing cap member on the roof sheets with a top portion spaced above the curved roof sheets and maintained in the spaced position by hatch coaming to reinforce the hatch openings. The car also includes a longitudinally extending hollow side sill with bolster posts located at each end and interconnecting the side sill with the side plate in such a fashion as to provide a reinforcing frame encircling the curved side wall sheets and curved roof sheets to hold the curved sheets in position during car movement.

10 Claims, 6 Drawing Figures

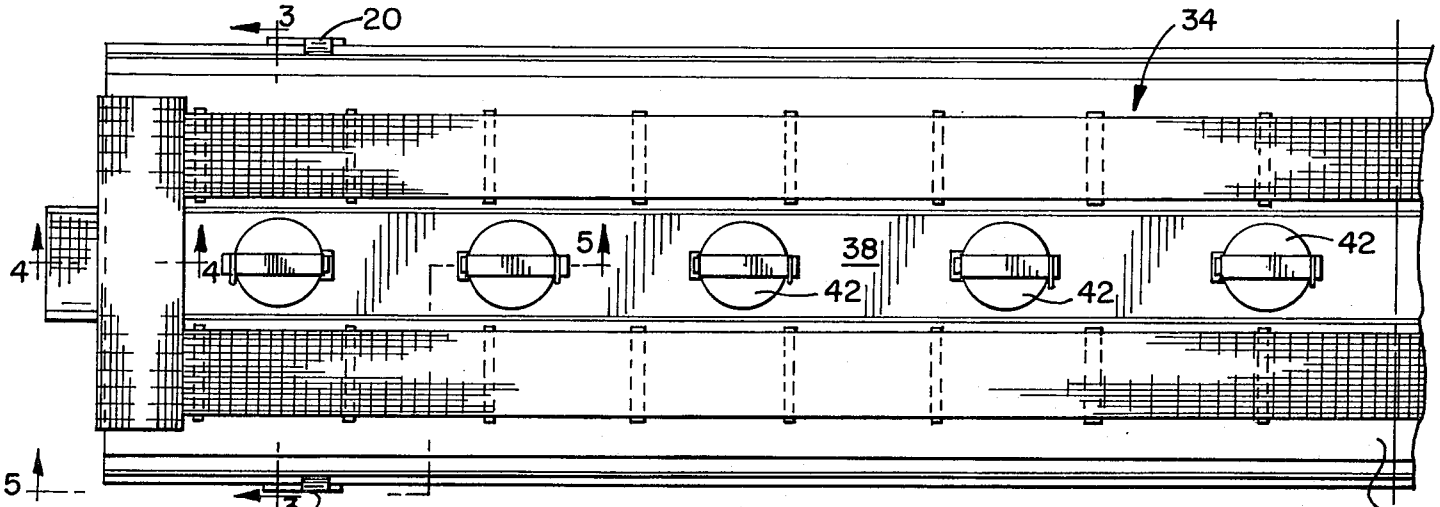
FIG. 2
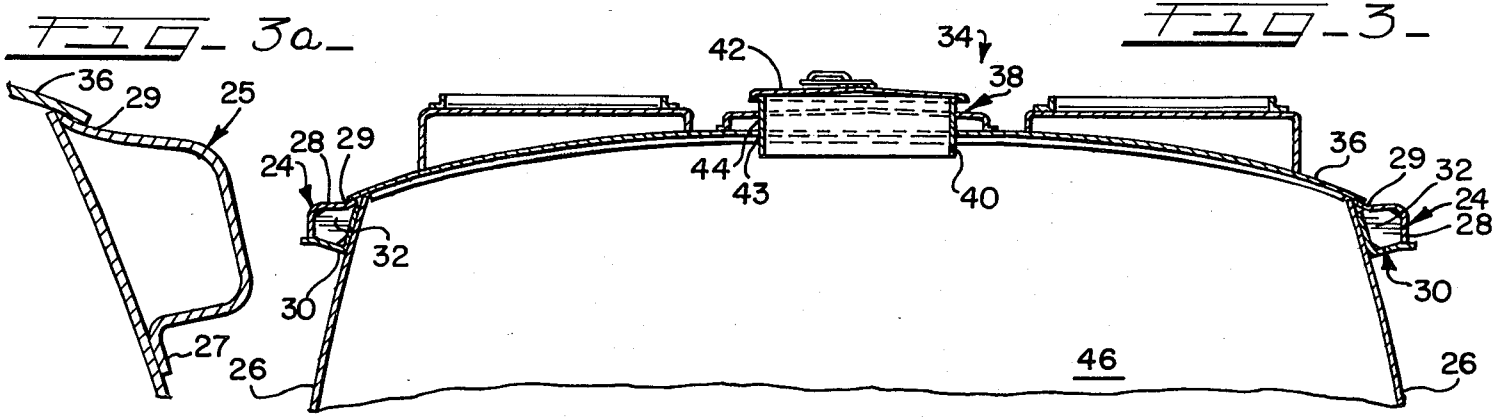
FIG. 3
FIG. 3a

COVERED HOPPER CAR

BACKGROUND OF THE INVENTION (1) Field of the Invention

This disclosure pertains to covered hopper cars used in the railroad field, and in particular to a car having a curved roof and side wall structure and a reinforcing frame of side sill, side plate and bolster posts surrounding the curved sheets of those vehicles.

(2) Description of the Prior Art

Covered hopper cars known in the prior art have always attempted to stay within the AAR size limitations and yet provide maximum capacity to the car. While various attempts have been made in the past by providing curved sides having internal bracing members or flat sides with external posts to reinforce the wall structures, the search continues for a design which is economical to manufacture and assemble and yet provides a near optimum capacity. The present invention provides curved side wall sheets and a curved roof structure which closely fits snugly within the AAR guide plate requirements and has a side plate, side sill and so-called upwardly extending bolster posts which provide sufficient reinforcing framing to securely hold the curved side wall and roof units. Also, the car has a center sill which provides much strength and allows for economical construction by eliminating the need for a massive end structure to transmit buff and draft forces coupling, uncoupling and other forces encountered during transit from the car end into the side sills and wall structure.

SUMMARY

This disclosure pertains to covered hopper cars used in railway service and in particular to so-called plastic pellet cars having a number of hatch openings on the top of the car and pneumatic discharge openings for removing plastic pellets from the hoppers. More specifically, this disclosure relates to a car framing and construction providing a curved skin-type of roof sheet and curved skin-type of side wall sheet fitted about a car framing structure provided by a continuous center sill, large, continuous side plates and side sill units interconnected by so-called bolster posts which, in combination, provide a hollow beam skeletal framing construction and rigidify the car and provide maximum internal capacity and high strength.

The curved roof sheets have a continuous cap member extending the length of the car and having a top portion spaced from the roof sheets and also having downwardly extending legs for attachment of the cap member to the roof structure. The cap member provides additional framing to reinforce the hatch opening cutouts and also provide a hollow beam member for rigidifying the car roof structure.

It is thus an object of this disclosure to show an improved covered hopper car for railroad service having curved sides and a curved roof structure interconnected with a side plate having a hollow beam construction and located externally of the hoppers.

It is yet another object of this disclosure to show a covered hopper car having a curved roof and curved sides and having a framing structure providing hollow beams for the side sill and side plate being interconnected by upstanding bolster posts and cooperating with a cap member which runs down the middle of the roof sheets to provide a skeletonized car onto which a curved roof and side sheets may be easily attached.

Another object of this disclosure is to show a covered hopper car for plastic pellet service and having a center sill extending the length of the vehicle.

These and other objects of the disclosure will become apparent to those having ordinary skill in the art with reference to the following description, drawings, and claims.

DESCRIPTION OF THE DRAWINGS

FIG. 2 is a top plan view with portions removed of the car illustrated in FIG. 1;

FIG. 3 is a sectional view taken generally along lines 3—3 of FIG. 2;

FIG. 3*a* is a cross-sectional view of a one piece side plate;

DESCRIPTION

Figure 1:
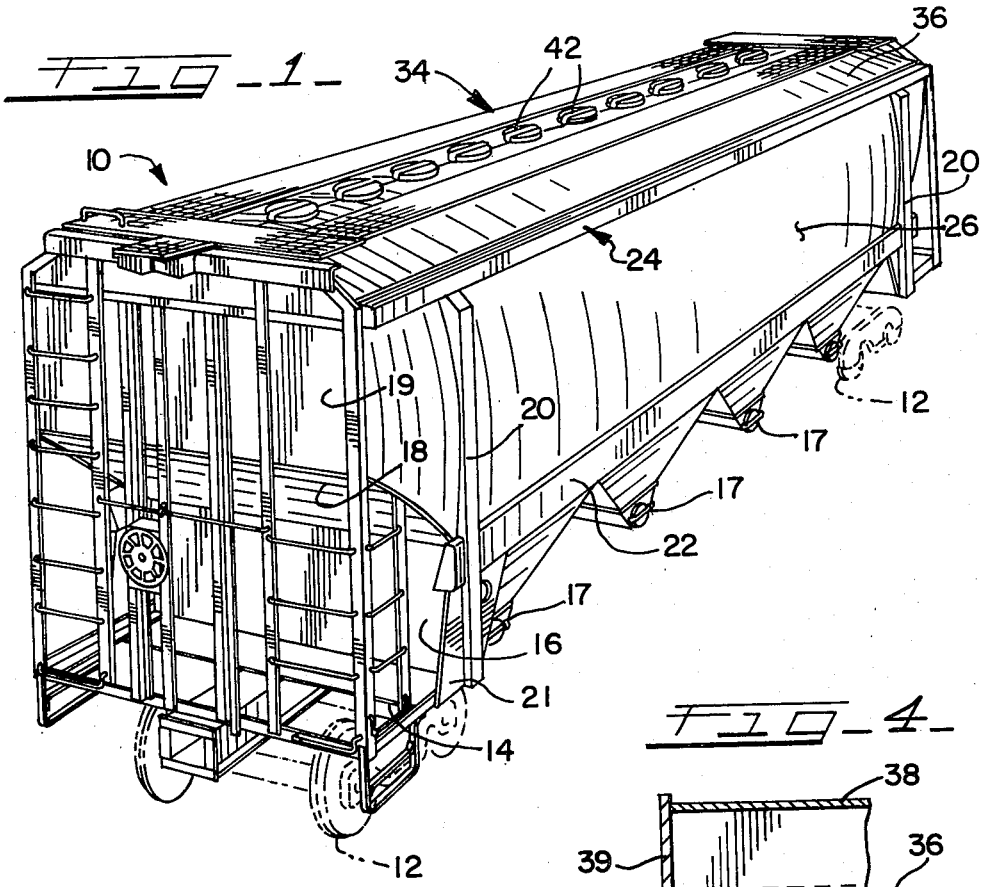
FIG. 1 is a pictorial illustration showing the covered hopper car disclosed herein.

Referring now to the drawings, and in particular to FIG. 1, there is shown a covered hopper car 10 supported on the usual trucks 12 shown in phantom. A pair of transversely extending bolsters 14 are supported upon the trucks and include an upstanding bolster web 16 connected with the underside of end slope sheet 18. A number of discharge outlets 17 are located at the bottom of each hopper for easily unloading lading from the car 10. End slope sheet 18, directs lading to the end discharge outlet and is connected to end bulkhead 19. A so-called bolster post 20 is attached at the outer edges of the bolster 14 and extends upwardly, side gusset plates 21 form a reinforced connection between bolster 14 and posts 20. A longitudinally extending side sill 22 extends between the space bolster posts 20. A so-called side plate 24 is located at the top of the side wall unit and also extends the length of the car and also interconnects the upstanding bolster posts 20. The framing structure thus described of the bolster 14, posts 20, side sill 22 and side plate 24 provides a rectangular, high strength structural unit framing the side wall unit and also providing high strength framing to support and rigidify the roof structure to prohibit excessive deflection (strain) of the curved sheets and other car components during transit, yet allow forces encountered during transit to be evenly distributed throughout the car body to thus prevent stress concentrations and fatigue failures.

Curved side wall sheets 26 extend between the side sill 22 and the side plate 24 and are securely attached thereto. As shown in the FIG. 3, the side plate 24 has an outer angle member 28 having a lip 29 and is mounted about and adapted to fit over the inner angle 30. It is noticed from the illustration, that the inner and outer angle members 28, 30 may be identical. The inner angle member 30 is securely attached to the side sheets 26 and the outer angle member 28 has lip 29 securely attached to the roof sheets 36. Partition plates 32 are positioned within the side plate 24 to further rigidify the assembled structure. It is noticed in the illustrations that the positioning and construction of the side plate 24 provides a rigid beam member which is positioned on the outside of the vehicle and does not subtract from any of the volume of the hoppers.

FIG. 3*a* shows a modified, one piece side plate 25 which is positioned and attached to the roof sheets 36 and side sheets 26 in the same fashion as the two piece side plate just described.

Figure 4:
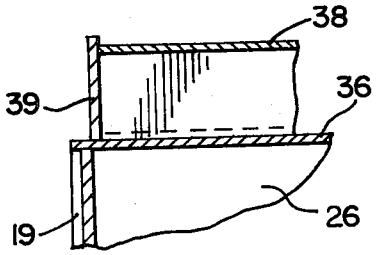
FIG. 4 is a sectional view of the end of the car structure taken generally along lines 4—4 of FIG. 2.
Figure 5:
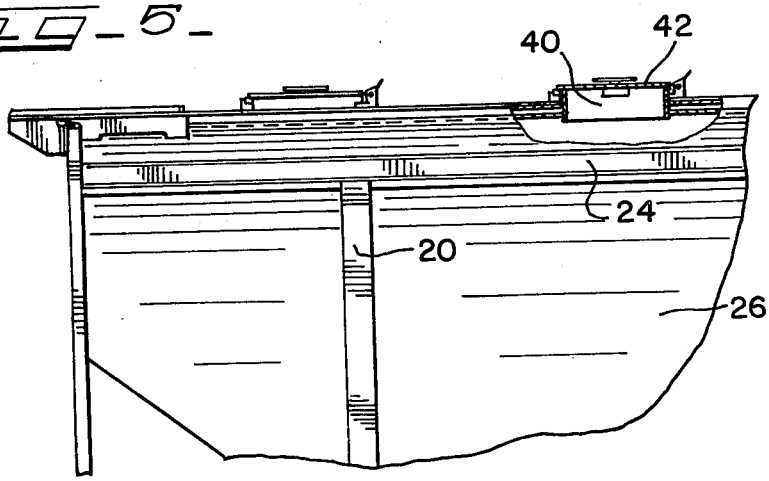
FIG. 5 is a view taken generally along lines 5—5 of FIG. 2.

The roof unit 34 includes curved roof sheets 36 which extend from side to side of the vehicle and have outer margins overlapping and securely attached to the lip 29 of the outer angle members 28. Extending down the central portion of roof unit 34 is a cap member 38 which has a top surface spaced from the roof sheets 36 and is connected atop the roof sheets by downwardly depending legs. The ends of cap plate 38 are closed off by cover plate 39 (FIG. 4). The roof sheets 36 and the cap member 38 have a number of openings contained therein in a line extending longitudinally of the hopper car 10 to receive hatch coaming 40. Coaming 40 is attached to the roof sheets 36 and to the top of the cap plate 38 at 43, 44. Thus, the coaming serves the double function of directing lading into the hoppers and also structurally reinforcing the area around the hatch openings and preventing excessive deflection and twisting of the roof structure.

The side wall sheets 26 and the roof sheets 36 have a curved contour to thus increase the capacity of the hoppers and yet keep the car profile within size requirements for railroad cars. For example, for a car 59'-7" in length over the end sheets the outside radius for the wall sheets is 170" and the inside radius of the roof sheets is 104" taken from a point 15⅞" from the center line of the car. These radii may vary or be modified and are given here as an example of dimensions for a hopper car having a 5800 cubic foot capacity. The side sheets and roof sheets are initially formed into a curved configuration and are further held in a curved configuration when they are fitted about intermediate bulkheads 46 and held in place by side sill 22, side plate 24 and the curved contour of the bolster posts 20.

It has thus been shown by the foregoing description that the covered hopper car disclosed herein provides a high volume car having a simplified construction which is easily fabricated and has a high strength to weight ratio because of the bolster posts 20, side plate 24, side sill 22 provide a construction which provides high strength framing members to hold the curved side sheets and curved roof sheets in position and provide structural integrity to resist twisting, buckling and stress fractures which can occur during high speed, loaded transit.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A railway hopper car adapted to carry lading which is loaded through hatch openings at the top of the car and discharged at the bottom of the car through discharge openings, the improvement comprising:

spaced side wall units extending the length of the hopper car and including a side sill connected to bolsters at each end thereof and a side plate;

said side wall units comprising side sheets having an arcuate shape;

bolster posts extending upwardly from the bolster connection with the side sill having means connected to the side sill and side plate to form structural reinforcing rectangles surrounding the sides and top of the hopper car;

a roof unit having roof sheets extending across the top of the car and including curved portions sloping from the hatch openings, outwardly and downwardly to side margins adjacent the side wall units;

said side plate located at the juncture of the roof sheets and side wall unit and including means connecting the curved portions with the side sheets;

said side plate comprising a longitudinally extending beam member with a first portion abutting and attached to the top margin of the side sheets and a side extending outwardly from the roof sheets;

said side plate also including a second portion having means connected to the side sheets and with said first portion forming a hollow beam on the outside of the hopper car and extending to reinforce the upper portion of the side wall units.

2. The hopper car of claim 1 and said side wall units including:

said side sill comprising a hollow beam member spaced vertically from the side plate and located at the lower margin of the side wall units;

said bolster posts having means extending vertically at each end of the hopper car and having means connected to the side sill and to the side plate and providing means conforming with the side sheets.

3. The hopper car of claim 1 wherein said roof unit includes hatch openings and:

a centrally located cap member with means extending the length of the hopper car and having a top portion spaced above the roof sheets and having depending legs connected with the roof sheets and providing a reinforcing member to strengthen the roof unit.

4. The hopper car of claim 3 wherein said hatch openings includes:

a first opening in the cap member;

a second opening aligned with the first opening and located in the roof sheets.

5. The hopper car of claim 4 wherein said hatch openings further include:

upstanding coaming including means connected to and extending through the first and second openings and providing spacer means for maintaining spacing between the roof sheets and the top portion of the cap member for reinforcing the hatch openings.

6. The hopper car of claim 1 wherein said side plate includes:

said second portion comprising an inner angle member with a first side adjacent said side sheets and a second side extending outwardly from the first side;

said first portion comprising an outer angle member with an outer side and a top side;

means connecting said inner and outer angle members and forming an enclosed, hollow beam.

7. The hopper car of claim 6 wherein said second plate member includes:

a lip portion extending under the adjacent side margin of said roof sheets;

means attaching said lip with the side margin of the roof sheets and thereby rigidifying and stabilizing the side margin.

8. A railway hopper car adapted to carry lading which is loaded through hatch openings at the top of the car and discharged at the bottom of the car through discharge openings, the improvement comprising the combination of:

a through center sill extending the length of the car;

spaced side wall units extending the length of the hopper car and including a side sill connected to bolsters at each end thereof and a side plate;

said side wall units comprising side sheets having a curved shape between the side sill and side plate;

bolster posts extending upwardly from the bolster connection with the side sill having means connected to the side sill and side plate to form structural reinforcing rectangles surrounding the side wall units and top of the hopper car and combining with the center sill to form the car reinforcing structure;

a roof unit having roof sheets extending across the top of the car and including curved portions sloping from the hatch openings, outwardly and downwardly to side margins adjacent the side wall units;

said side plate located at the juncture of the roof sheets and side wall unit and including means connecting the roof sheets with the side sheets;

said side plate comprising a longitudinally extending beam member with a first portion abutting and attached to the top margin of the side sheets and a side extending outwardly from the roof sheets;

said side plate also including a second portion having means connected to the side sheets and with said first portion forming a hollow beam on the outside of the hopper car and extending to reinforce the upper portion of the side wall units.

9. The railway hopper car of claim 8 wherein said side sheets of the wall units include:

first metal sheet members curved to a constant radius along their entire heights between the side sill and side plate.

10. The railway hopper car of claim 8 wherein said curved portions of the roof sheets include:

second metal sheet members curved to a constant radius between the hatch openings and the side plates and thereby providing a roof surface extending downwardly as it extends outwardly from the hatch openings to the side plate.

* * * * *